United States Patent [19]

Setterberg

[11] Patent Number: 4,602,796

[45] Date of Patent: Jul. 29, 1986

[54] WELL CONDUIT JOINT SEALING SYSTEM

[75] Inventor: John R. Setterberg, Richardson, Tex.

[73] Assignee: Otis Engineering Corporation, Dallas, Tex.

[21] Appl. No.: 626,442

[22] Filed: Jun. 29, 1984

[51] Int. Cl.[4] ..... F16J 15/08

[52] U.S. Cl. ..... 277/236; 277/30; 277/125; 277/171; 166/88

[58] Field of Search ..... 277/30, 123–125, 277/170–173, 176, 236; 166/86, 88

[56] References Cited

U.S. PATENT DOCUMENTS

| | | | |
|---|---|---|---|
| 1,389,920 | 9/1921 | Weaver et al. | 166/86 |
| 1,625,378 | 4/1927 | Snodgrass | 166/88 |
| 1,642,745 | 9/1927 | Pearce et al. | 166/88 X |
| 3,001,803 | 9/1961 | Watts et al. | 166/88 X |
| 3,104,121 | 9/1963 | Nordin et al. | 277/236 X |
| 3,302,736 | 2/1967 | Kisling | 277/236 X |
| 3,602,303 | 8/1971 | Blenkarn et al. | 166/88 X |
| 3,797,835 | 3/1974 | Wehner | 277/171 X |
| 4,288,082 | 9/1981 | Setterberg | 277/125 |
| 4,291,768 | 9/1981 | Diehl | 166/88 X |
| 4,384,730 | 5/1983 | Diehl | 277/236 |

*Primary Examiner*—Robert S. Ward
*Attorney, Agent, or Firm*—Ronald O. Cox

[57] ABSTRACT

A system and apparatus useful in establishing a metal to metal seal between members in wells. A milling tool is used to cut and/or finish a seat on a shoulder in pipe or tools in the well, which will mate and seal with metal seal surfaces on seal units lowered into the well. One seal unit has elastomeric seals in addition to the metal seals.

8 Claims, 14 Drawing Figures

WELL CONDUIT JOINT SEALING SYSTEM

BACKGROUND

This invention relates to apparatus for repairing or cutting a seat for a metal seal in a conduit or tool member in an earth well and metal seal apparatus for installation in the well to seal on the seat.

There have been a number of failures of conventional seal rings made of elastomeric materials, which were used to seal in bores in downhole well tools, anchored in well casing. These seal rings are usually mounted on a tubular seal unit connected to the lower end of flow conducting pipes lowered into the well and into a tubular seal receptacle on top of downhole well tools, such as liner hangers or production packers, which has been smooth bored inside for sealing. Examples of such use of elastomeric seals is shown on page 1456 of the 1982–83 "Composite Catalog of Oilfield Equipment and Services", in the form of o-ring and compression seals on "tie-back" stems and packers.

A sealing system utilizing elastomeric and metal seal rings is disclosed in U.S. Pat. No. 4,288,082, of which I am the inventor. Another example of a sealing system utilizing metal, elastomeric and thermoplastic materials, is disclosed in U.S. Pat. No. 4,433,847 to Weinberg.

The apparatus and method of this invention provide a milling tool for cutting and/or finishing a seat on a shoulder in a tubular member of a well tubing string or tool anchored in the well casing. A seal unit, having a deformable metal seal ring slidably mounted near an outside seal surface on its lower end, is then lowered on pipe into the well until an outside seal surface on the ring engages the seat. Weight of the pipe lowering string is then applied to the seal unit, which compresses the metal ring between the seat and seal unit. and deforms the metal seal ring sufficiently to seal on the seat and seal unit and establish the seal between the seal unit and well tool. The metal replacement seal of this invention will better resist high deep well temperatures and chemical deterioration of elastomeric materials caused by hydrocarbons in earth wells and provides a much longer lasting and more reliable seal than elastomeric material seals previously used. Higher pressures can be sealed because much greater compressive loads can be placed on the metal seals than on elastomeric materials.

The milling tool of this invention provides for formation of a seat in a tubular well member while the member is installed in the well. This milling tool will cut and smooth finish the whole seat or "redress" or smooth finish for sealing a seat previously cut. The downward force of the milling tool cutter on the seat may be controlled. The profile formed by the milling tool mates with the outside seal surface on the metal ring and the outside seal surface on the lower end of the seal unit. The seal unit metal ring is thicker, in the section compressed between the seat and the seal unit, and prevents the outside seal surface on the lower end of the seal unit from initially engaging the seat. When sufficient load is placed on the seal unit to compress the metal ring between the seal unit and seat and reduce the thickness of the metal ring, the outside seal surface on the lower end of the seal unit also engages the seat and forms an additional metal to metal seal with the seat prepared by the milling tool. The additional seals' diameter of seal is smaller than the seal rings' diameter of seal and the additional seal exposes a smaller sealed area reducing the "piston" force trying to move seal unit up. Additionally, the smaller sealed area on the additional seal provides for the sealing greater pressures with the same load down on the seal unit. Further, the additional area engaged in compression provides for the support of greater pipe loads on the seal unit and prevents the slidable metal ring from being crushed so it will no longer seal.

The system of this invention is particularly useful to replace failed elastomeric downhole well seals with longer lasting metal seals and reseal between well tool members allowing the well to continue production.

Downwardly and inwardly tapering angles of 5° to 45° with the longitudinal axis of the tools were found useful for all metal seal surfaces. Angles of 12°–15° were found preferable for metal seal surfaces and cutting on seats with the milling tool.

An object of this invention is to provide apparatus and a method for establishing an improved seal between tubular members in a well.

An object of this invention is to provide apparatus for cutting and/or finishing a seat having a particular profile in a tubular member in a well.

Another object of this invention is establish the improved seal by retrieving only one tubular member from the well.

BRIEF DRAWING DESCRIPTION

FIG. 1 is schematic drawing of a well wherein downhole tools have been sealed using the improved seal unit and apparatus of this invention.

FIGS. 2A, 2B, 2C, 2D, 2E, and 2F together is a half sectioned drawing in elevation, of the milling tool of this invention.

Figure 5A:
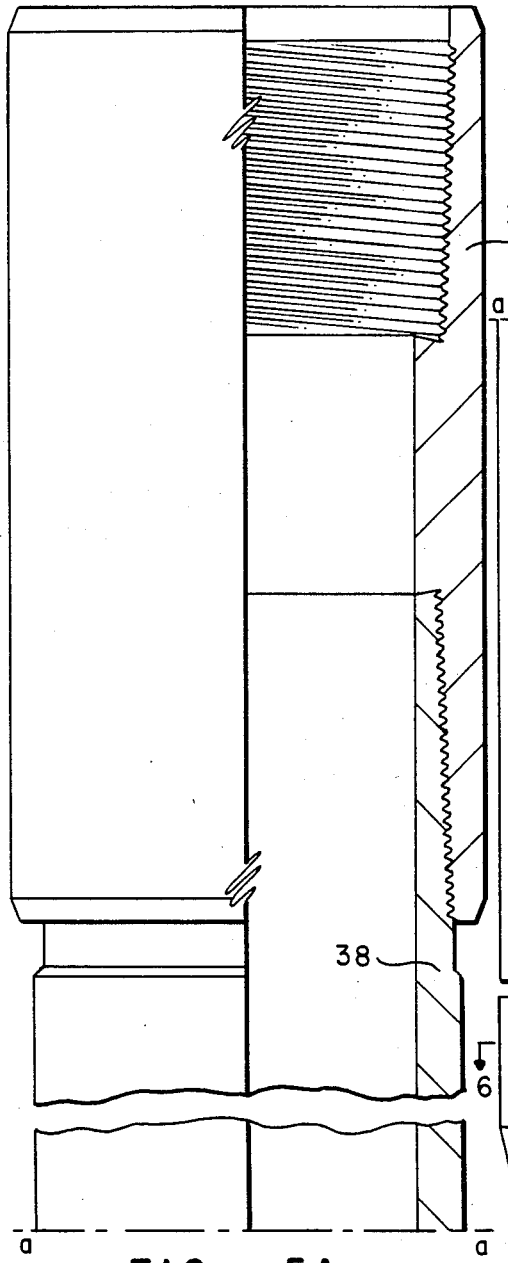
Figure 5B:
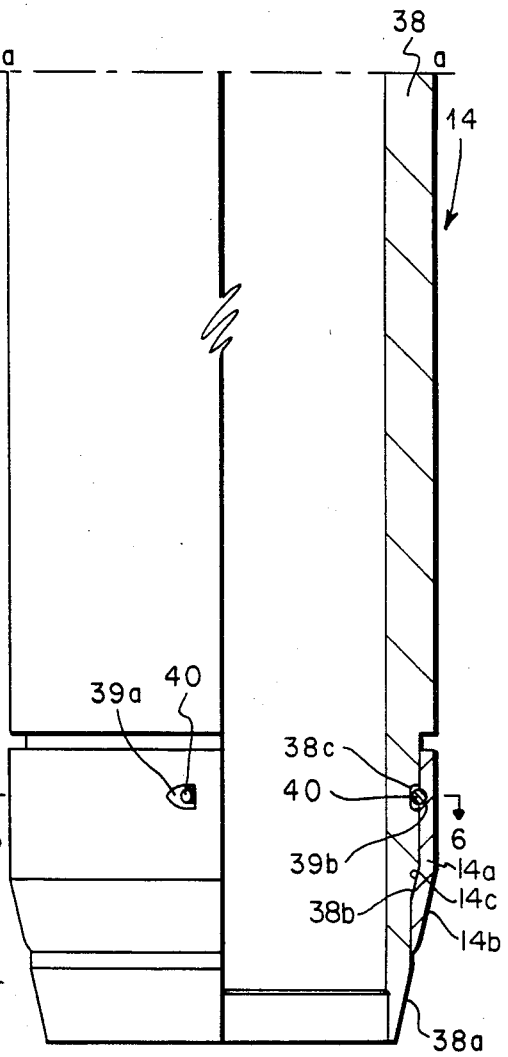

FIGS. 5A and 5B together is a half sectioned drawing in elevation of a seal unit having a metal seal ring on the lower end.

Figure 6:
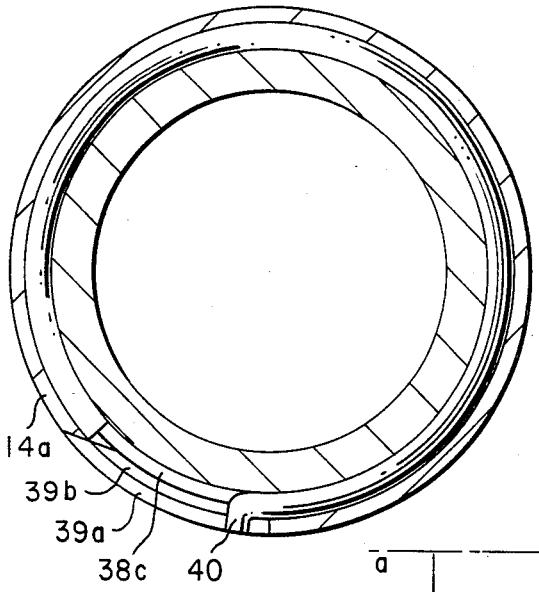

FIG. 6 is a section along lines 6—6 of FIG. 5, showing detail of the metal seal ring-seal mandrel connection.

Figure 7B:
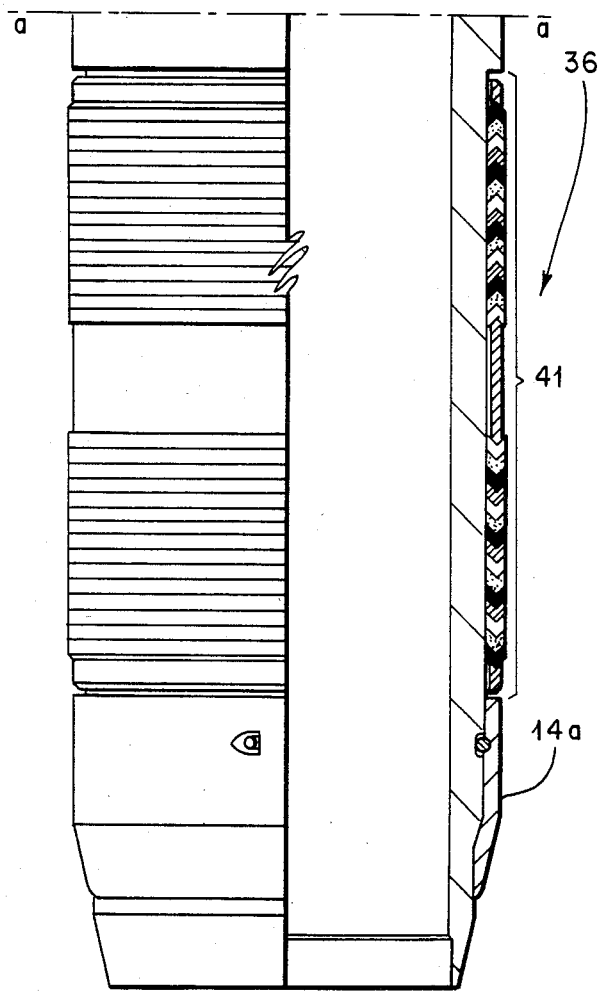
Figure 7A:
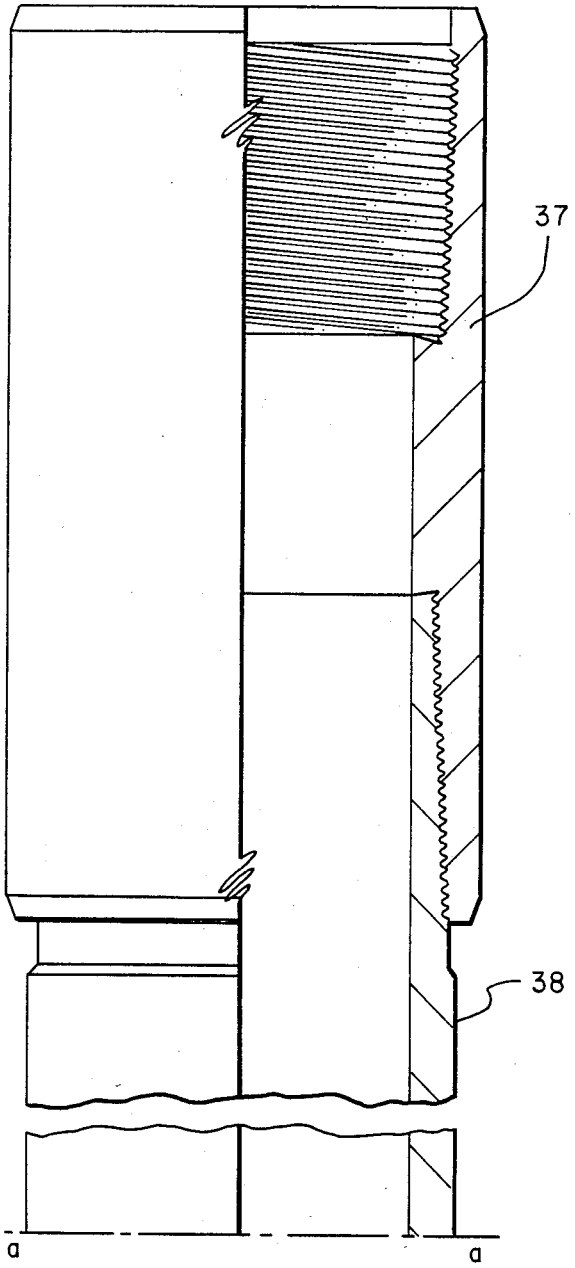

FIGS. 7A and 7B together is a half sectioned drawing of the seal unit of FIG. 5 with an elastomeric seal section above the metal seal.

DESCRIPTION OF THE PREFERRED EMBODIMENT

Figure 1:
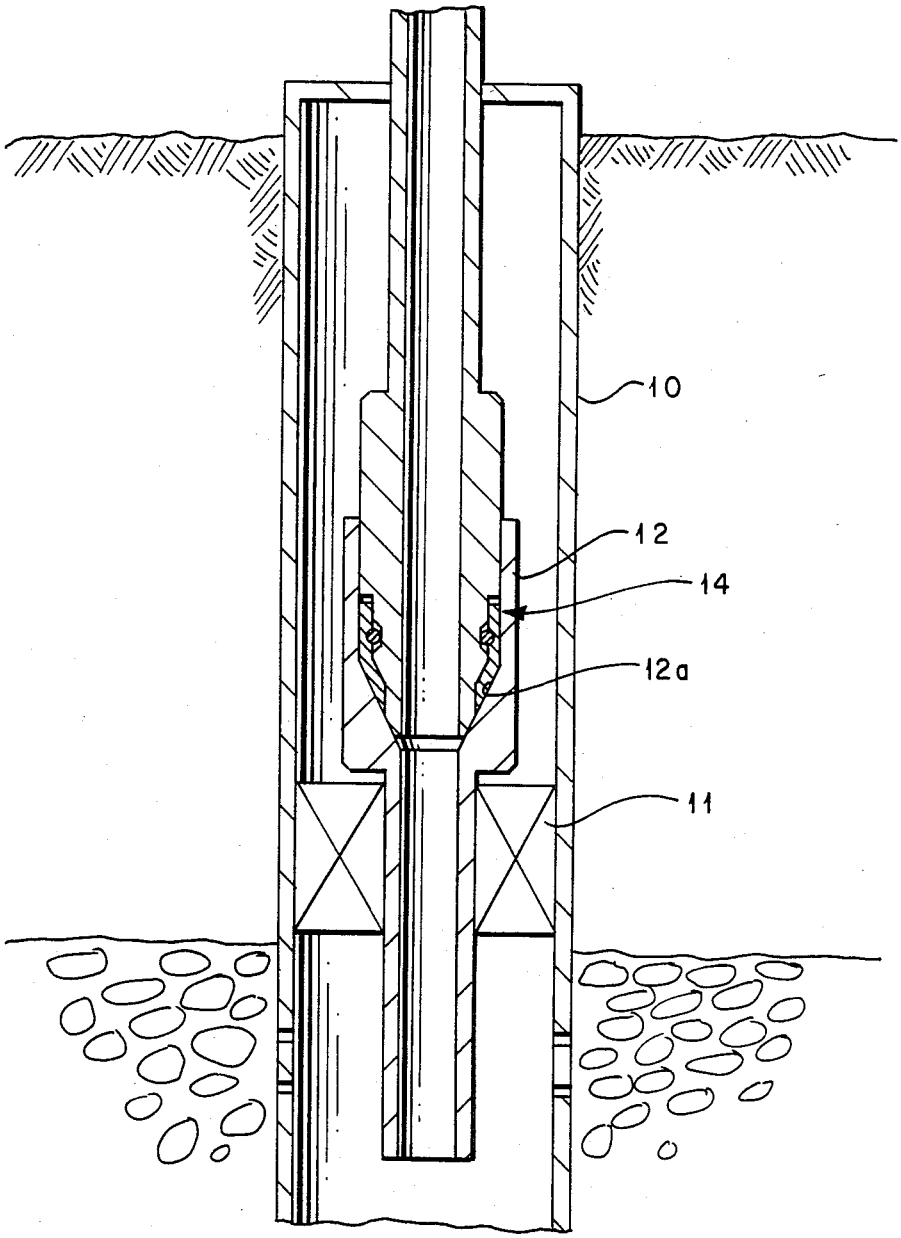
Figures 2A, 2B:
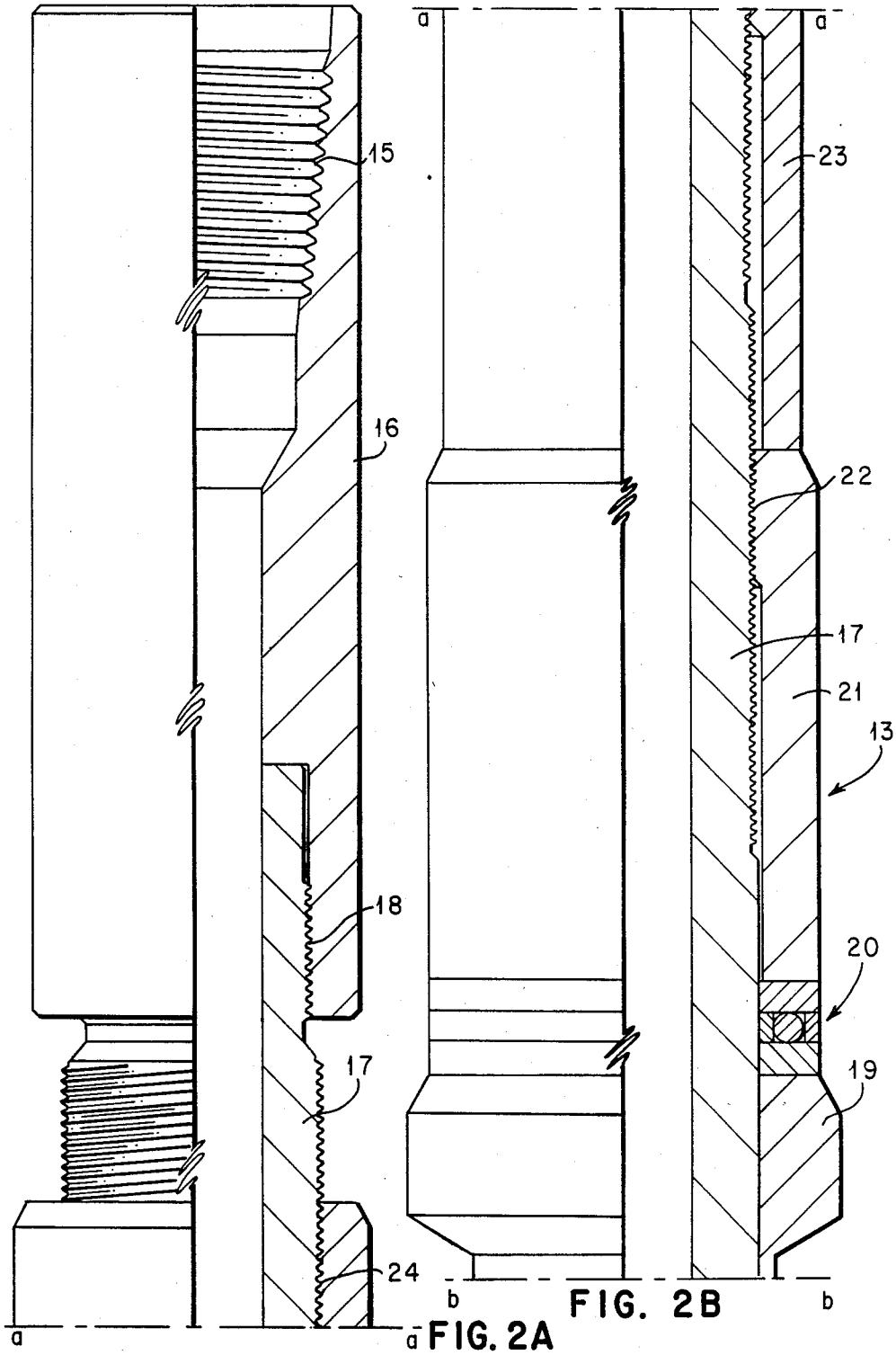
Figure 2C:
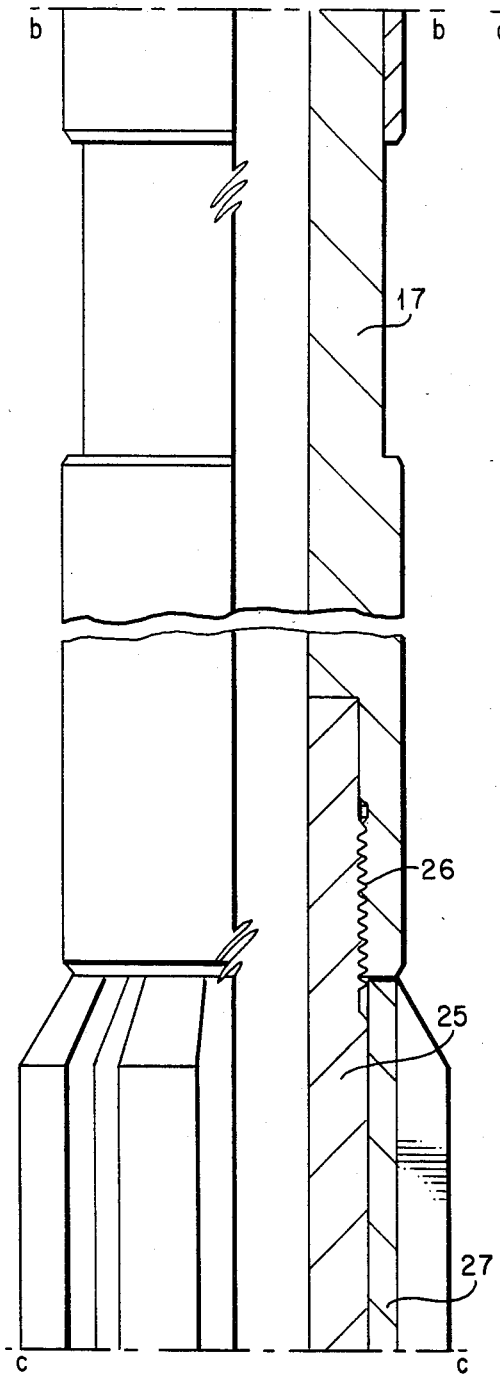
Figure 2D:
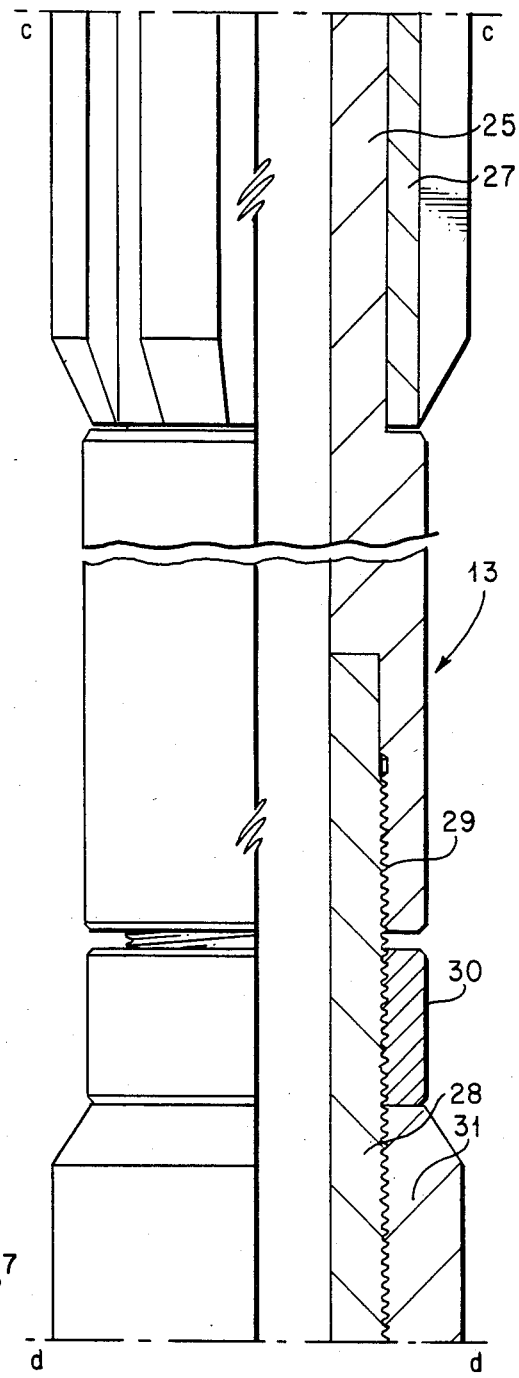
Figure 2E:
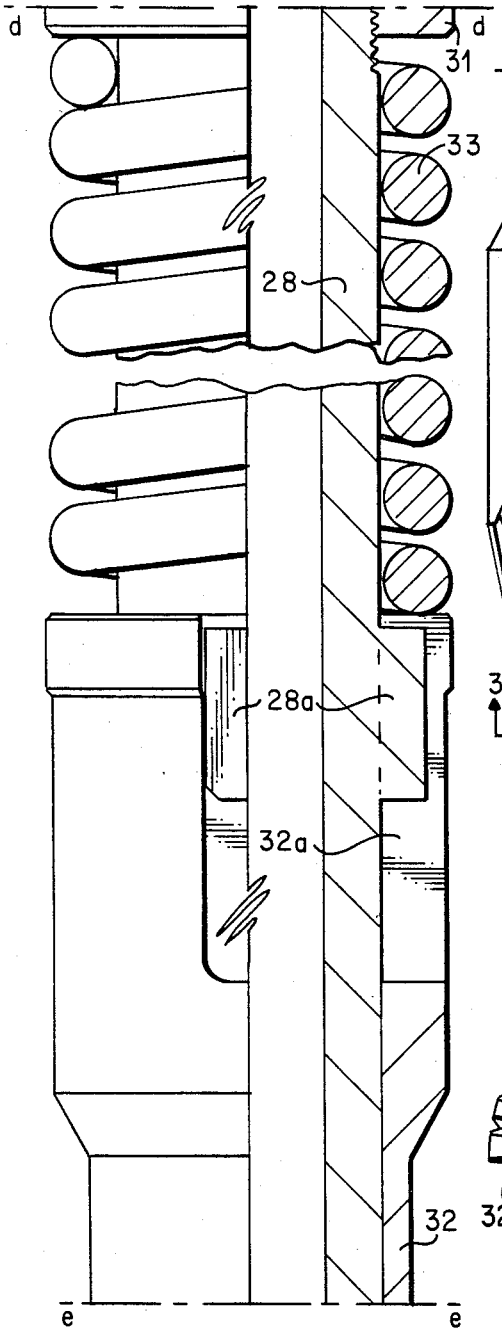
Figure 2F:
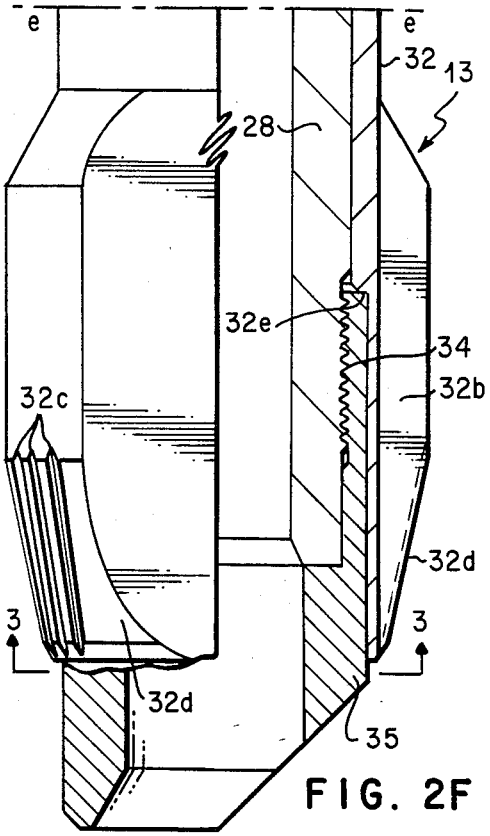
Figure 3:
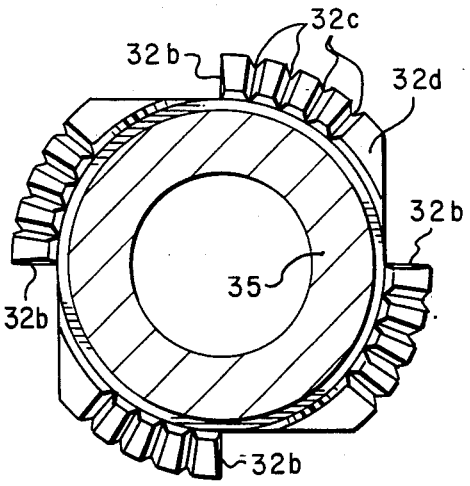
FIG. 3 is a section along line 3—3 of FIG. 2.

FIG. 1 shows an earth well utilizing the system of this invention. A casing 10 has been installed in the earth bore hole. A packer 11, set in the casing, positions therein a well tool or pipe 12 having an internal shoulder. A seating surface **12*a* has been formed for sealing on the shoulder, using milling tool 13 of this invention shown in FIGS. 2A, 2B, 2C, 2D, 2E, and 2F. A seal unit 14 (FIGS. 5A and 5B) having a lower metal seal ring 14*a* has been attached to a well pipe and lowered into the well until the seal ring is resting on prepared sealing surface 12*a***. The milling tool has cut a profile on the shoulder which mates with the contacting profile on the seal unit seal ring. Well pipe weight has been applied to the seal unit, compressing and deforming the metal seal ring into complete sealing engagement with the shoulder seal surface.

Sufficient pipe weight has been added to compress the metal seal ring between angled seal surfaces on the seal mandrel and seal surface 12*a* to also sealingly engage the mandrel lower end outside seal surface with sealing surface 12*a*.

The milling tool 13 of FIGS. 2A, 2B, 2C, 2D, 2E, 2F has an appropriate thread connection 15 in top sub 16 for connection to a rotatable well pipe. The top sub is connected to upper mandrel 17 with thread 18. Slidably mounted on this mandrel is a shoulder ring 19 and a bearing 20. An adjusting ring 21 is movable by screwing up or down thread 22 on the mandrel. A lock ring 23 may be tightened against the adjusting ring on mandrel thread 24. An intermediate mandrel 25 is connected to the lower end of the upper mandrel with thread 26. A slotted guide sleeve 27 is rotatably positioned on the intermediate mandrel between the lower end of the upper mandrel and a shoulder on the intermediate mandrel. Lower mandrel 28 is provided with drive lugs 28*a* and is connected to the intermediate mandrel with threads 29. Mounted on threads 29 is lock ring 30 and an adjusting ring 31. Also mounted around the lower mandrel, between the adjusting ring and a cutter 32, is a spring 33. The cutter is provided with slots 32*a*, in which drive lugs 28*a* are slidably positioned and cutting or milling surfaces 32*b* and grooves 32*c* are formed on the surfaces 32*d* of the cutter for cutting a particular seat profile on an internal shoulder in a receptacle. Surfaces 32*d* form an angle of preferably 12° to 15° with the longitudinal axis of the cutter. Connected to the lower end of lower mandrel 28 by thread 34 is a guide 35. Adjusting ring 31 may be screwed down compressing spring 33 causing inernal cutter shoulder 32*e* to bear down with greater force on the upper end of the guide.

The seal unit 14 shown in FIGS. 5A and 5B, has a threaded connector 37 on its' upper end for connecting seal mandrel 38 to the lower end of flow pipes lowered into wells. Seal surfaces 38*a* and 38*b* on the lower end of the seal mandrel are formed at preferred angles of 12° to 15° with the longitudinal axis of the mandrel. Slidably mounted on the lower end of the mandrel is a metal seal ring 14*a*. The ring is retained in a groove 38*c*, around the mandrel, by a wire 40 driven thru a slot 39*a* in the metal ring and into groove 38*c* and groove 39*b* in the metal ring, as shown by FIGS. 5 and 6.

The slidably connected metal ring fits loosely around the seal mandrel and may be moved slightly radially on the mandrel, allowing the metal ring to misalign slightly with the seal mandrel and still sealingly engage a slightly misaligned seat. Seal 14*a*, FIG. 5B, has an angled outside seal surface 14*b* which is sealingly engageable with seat 12*a* and an angled inside seal surface 14*c* which is sealingly engageable with angled outside seal surface 38*b* on mandrel 38.

Seal unit 36 shown in detail in FIGS. 7A and 7B, has an additional elastomeric seal section 41 on the seal mandrel above the metal seal ring. In some wells, it is very desirable to have one or more elastomeric seal sections in addition to the metal seal on seal units for complete and longer lasting sealing, especially if there is a seal receptacle above the metal seal shoulder in the tool anchored in the well.

To utilize this inventin and establish an improved metal to metal seal between pipes or tools in a well, the leaking seal unit is removed from the tool anchored in the well casing and retrived from the well. A milling tool, as shown in FIGS. 2A, 2B, 2C, 2D, 2E and 2F, which may be adjusted to control downward force compressed spring 33 exerts on top of cutter 32 to engage shoulder 32*e* with the top of guide 35, by turning adjusting ring 31 and securing the ring's position with ring 30. This adjustment may be used to control cutter force down on the shoulder in the well tool while forming the seal surface. The milling tool is next attached to rotatable pipe and lowered into the well, until surface 32*d* on cutter 32 contacts the internal shoulder in the tool anchored in the well, on which is to be formed a seal surface to sealingly engage the metal seal surfaces on seal units 36 or 14. Pipe weight is then applied on the milling tool, moving the milling tool mandrels downwardly, compressing spring 33 and forcing the cutter down on the shoulder, while moving the upper end of guide 35 out of contact with cutter shoulder 32*e*. *The milling tool is then rotated by turning pipe at the surface until the shoulder in the anchored tool is properly formed and smoothed into a seal surface and cutter shoulder 32e* is again bearing on the upper end of guide 35. The pipe and milling tool are retrieved from the well and seal unit 14 is made up on pipe to be lowered into the well to engage and seal on the prepared seal surface.

Figure 4:
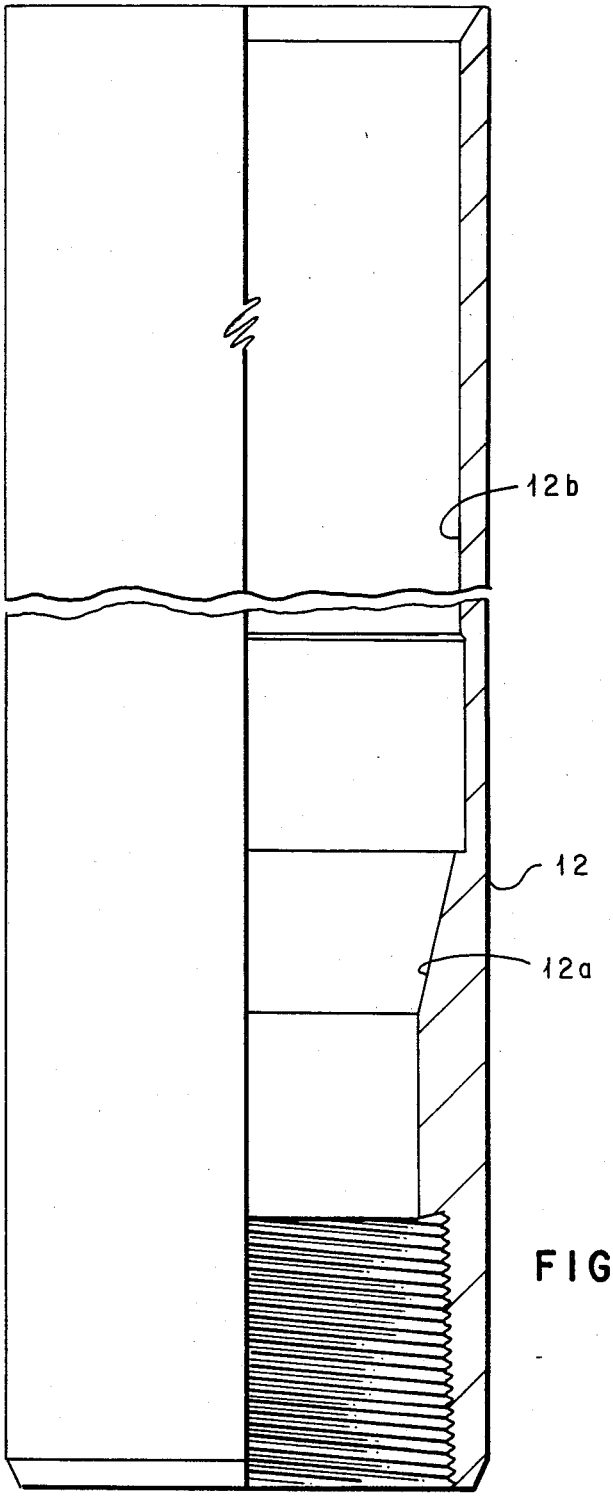
FIG. 4 is a drawing in elevation of a typical seal receptacle in which the milling tool of FIG. 2 has formed a seat.

If the tool anchored in the well has a seal receptacle such as 12, FIG. 4, with a bore 12*b* for seals, the distance from the top of the receptacle to the shoulder on which the seat 12*a* to be formed is usually known. Before the milling tool is lowered to form the seal surface, to limit downward cutting travel of the cutter, shoulder ring 19 and bearing 20 may be positioned a predetermined distance from cutter surfaces 32*d* by rotating adjusting ring 21 and locking it in place with ring 23. The cutter force down may be adjusted as previously described. The milling tool is then lowered into the well receptacle until cutter surfaces 32*d* contact the shoulder to be formed. Pipe weight on the milling tool will move the milling tool mandrels downwardly compressing spring 33 which pushes cutter 32 downwardly on the shoulder, until shoulder ring 19 contacts the receptacle top and positions milling tool guide 35 to stop downward movement of the cutter.

Rotation of the pipe will turn the milling tool mandrels on bearing 20 while compressed spring 33 moves the cutter shoulder 32*e* toward the top of guide 35 as the seal surface is being formed on the shoulder in the receptacle.

After the seal surface 12*a* is completely formed on the receptacle shoulder, the milling tool is retrieved from the well and a seal unit 36, FIGS. 7A and 7B with elastomeric seals 41 in addition to the metal lower end and ring seal 14*a*, should be installed in the receptacle to sealingly engage seal surfaces 12*a* and 12*b*.

What is claimed is:

1. A system for sealing conduit joints in a well comprising:

a. a metal seat in a well conduit, said seat having a frusto-conical sealing surface; and b. seal unit means including a metal mandrel, having an upper end connection, a first lower end outside frusto-conical sealing surface sealingly engageable with said well conduit seat, and a second larger outside frusto-conical sealing surface above said first sealing surface, a metal seal ring, having inside and outside sealing surfaces, said inside sealing surface being sealingly engageable with said second mandrel sealing surface and said outsie sealing surface being sealingly engageable with said conduit seat, and means for slidably connecting said ring on said mandrel.

2. The system of claim 1 wherein the means slidably connecting the ring on the mandrel comprise:

a. a recess around the mandrel;

b. a recess in the metal seal ring, said ring having a wall opening intersecting said recess; and c. a wire of diameter greater than the depth of either of said recesses, passed through said opening and into said recesses.

3. The system of claim 1 wherein the conduit sealing surface and the first and second mandrel sealing surfaces taper downwardly and inwardly forming angles of 5° to 45° with the longitudinal axis of the conduit and mandrel, respectively.

4. The system of claim 1 wherein the seal ring is deformable metal.

5. The system of claim 1 wherein the seal unit means further includes one or more elastomeric seal sections on the mandrel above the seal ring.

6. A system for sealing conduit joints in a well comprising:

a. a frusto-conical seat in a conduit in a well having a sealing surface forming an angle of from 5° to 45° with the longitudinal axis of said conduit; and b. a seal unit including a metal mandrel having an upper end connection, a first lower end outside frusto-conical sealing surface sealingly engageable with said well conduit seat, a second larger outside frusto-conical sealing surface, above said first sealing surface, said first and second sealing surfaces tapering downwardly and inwardly and forming an angle of 5° to 45° with the longitudinal axis of said mandrel, a deformable metal seal ring having an inside frusto-conical sealing surface sealingly engageable with said second mandrel sealing surface and an outside frusto-conical sealing surface sealingly engageable with said conduit seat, said inside and outside sealing surfaces tapering downwardly and inwardly forming an angle of 5° to 45° with the longitudinal axis of said ring; and means slidably connecting the seal ring on the mandrel including a recess around the mandrel, a recess inside the metal ring, said ring having a wall opening intersecting said recess, and a wire of diameter greater than the depth of either of said recesses passed through said opening and into said recesses.

7. The system of claim 6 wherein the seal unit further includes one or more elastomeric seal sections on the mandrel above the seal ring.

8. The system as defined in claim 3 wherein the seal unit ring inside and outside sealing surfaces taper downwardly and inwardly forming angles of from 5° to 45° with the longitudinal axis of the ring.

* * * * *